US005770813A

United States Patent [19]

Nakamura

[11] Patent Number: 5,770,813

[45] Date of Patent: Jun. 23, 1998

[54] SOUND REPRODUCING APPARATUS PROVIDES HARMONY RELATIVE TO A SIGNAL INPUT BY A MICROPHONE

[75] Inventor: Junichi Nakamura, Chiba, Japan

[73] Assignee: Sony Corporation, Tokyo, Japan

[21] Appl. No.: 783,247

[22] Filed: Jan. 14, 1997

[30] Foreign Application Priority Data

Jan. 19, 1996 [JP] Japan ..... 8-007843

[51] Int. Cl.[6] ..... G10H 1/36; G10H 7/00

[52] U.S. Cl. ..... 84/610; 84/616; 84/619; 434/307 A

[58] Field of Search ..... 434/307 A; 84/610, 84/616, 619, 634, 654, 657

[56] References Cited

U.S. PATENT DOCUMENTS

| | | | |
|---|---|---|---|
| 5,033,036 | 7/1991 | Ohmori et al. . | |
| 5,194,682 | 3/1993 | Okamura et al. | 434/307 A |
| 5,447,438 | 9/1995 | Watanabe et al. | 434/307 A |
| 5,499,922 | 3/1996 | Umeda et al. | 434/307 A |
| 5,518,408 | 5/1996 | Kawashima et al. | 434/307 A |
| 5,621,182 | 4/1997 | Matsumoto . | |
| 5,652,401 | 7/1997 | Nakamura | 84/619 |

*Primary Examiner*—William M. Shoop, Jr.
*Assistant Examiner*—Jeffrey W. Donels
*Attorney, Agent, or Firm*—Jay H. Maioli

[57] ABSTRACT

A sound reproducing apparatus used in Karaoke and the like uses a record medium or a communication medium on which an accompaniment sound signal, data indicative of a scale, and song standard information are recorded. The sound reproducing apparatus includes a reproducing section, a signal generating section and an adding section. The reproducing section reproduces the accompaniment sound signal and the data indicative of the scale from any of the media. The signal generating section generates a harmony signal relative to a sound signal from a microphone on the basis of the data indicative of the scale reproduced by the reproducing section and the song standard information. The adding section adds the sound signal from the microphone, the accompaniment sound signal reproduced by the reproducing section, and the harmony signal from the signal generating section to produce an output signal.

16 Claims, 5 Drawing Sheets

SOUND REPRODUCING APPARATUS PROVIDES HARMONY RELATIVE TO A SIGNAL INPUT BY A MICROPHONE

BACKGROUND OF THE INVENTION

1. Field of the Invention

The present invention relates to a sound reproducing apparatus. More particularly, the present invention relates to a sound reproducing apparatus which can generate a harmony signal.

2. Background of the Invention

Up to now, a sound reproducing apparatus is known that outputs and reproduces, as a music signal, music information obtained by reproducing an information signal record medium such as an optical disk or by receiving a signal (MIDI data) sent by a communicating means and further outputs and reproduces, as a voice signal, a voice inputted through a microphone device.

In this sound reproducing apparatus, when music based on a music signal is reproduced simultaneously with a song based on a voice signal from a microphone device, it is used as what is called a Karaoke apparatus. Such a music and a song can be reproduced with being electrically mixed with each other, or can be reproduced parallel to each other.

In the above mentioned sound reproducing apparatus used as the Karaoke apparatus, a type having a configuration described below is proposed. That is, it generates, based on the above mentioned voice signal, a harmony signal indicative of a harmony voice with a music interval having a relation of a harmony to a voice relative to the voice signal, and reproduces it with the original voice signal.

In the above mentioned sound reproducing apparatus, when a singer sings, for example, a harmony voice lower than the voice of the singer by three degrees is generated. Then, it is reproduced with the voice, and thereby the song constituting the harmony is reproduced.

Incidentally, in the sound reproducing apparatus having the above mentioned configuration in which the song constituting the harmony based on the voice of one singer is reproduced, the original voice has the same tone quality (tone characteristic) as the harmony voice with the music interval having the relation of the harmony to this voice.

In a case of reproducing the voices with more than one music interval constituting the harmony, if the tone qualities of these respective voices are the same, the power of expression expressing the harmony is weak as compared with a case in which the tone qualities of the respective voices are different from each other. That is, the case in which the harmony is constituted by reproducing the voices with more than two music intervals having the tone qualities different from each other can emphasize and express the harmony, as compared with the case in which the harmony is constituted by the voices having the same tone qualities.

SUMMARY OF THE INVENTION

It is therefore an object of the present invention to provide a sound reproducing apparatus which resolves the above mentioned problems.

According to the present invention to provide a sound reproducing apparatus, it uses a record medium on which an accompaniment sound signal, data indicative of a scale and song standard information are recorded. The sound reproducing apparatus includes a reproducing section, a signal generating section and an adding section. The reproducing section reproduces the accompaniment sound signal and the data indicative of the scale from the record medium. The signal generating section generates a harmony signal to a sound signal inputted from a microphone on the basis of the data indicative of the scale reproduced by the reproducing section and the song standard information. The adding section adds the sound signal outputted by the microphone, the accompaniment sound signal reproduced by the reproducing section and the harmony signal from the signal generating section to thereby produce and output.

According to the present invention to provide a sound reproducing apparatus, it uses a record medium on which a digital accompaniment sound signal, data indicative of a scale and song standard data are recorded. The sound reproducing apparatus includes a reproducing section, first and second converting sections, a signal generating section and an adding section. The reproducing section reproduces the digital accompaniment sound signal and the data indicative of the scale from the record medium. The first converting section converts a sound signal inputted from a microphone into a digital sound signal. The signal generating section generates a harmony signal to the digital sound signal from the first converting section on the basis of the data indicative of the scale reproduced by the reproducing section and the song standard data. The adding section adds the digital sound signal from the first converting section, the accompaniment sound signal reproduced by the reproducing section and the harmony signal from the signal generating section to thereby output. The second converting section converts the output signal from the adding section into an analog signal.

According to the present invention to provide a sound reproducing apparatus, it includes a receiving section, a signal generating section and an adding section. The receiving section receives a signal including an accompaniment sound signal, data indicative of a scale and song standard data. The receiving section has a demodulating section for demodulating the received signal. The signal generating section generates a harmony signal to a sound signal inputted from a microphone on the basis of the data indicative of the scale demodulated by the demodulating section and the song data as the standard. The adding section adds the sound signal outputted by the microphone, the accompaniment sound signal reproduced by the reproducing section and the harmony signal from the signal generating section to thereby output a summed signal.

Further objects and advantages of the present invention will be apparent from the following description of the embodiment of the invention as illustrated in the accompanying drawings.

DESCRIPTION OF THE INVENTION

A sound reproducing apparatus in accordance with the present invention is explained in detail with reference to the drawings.

Figure 1:
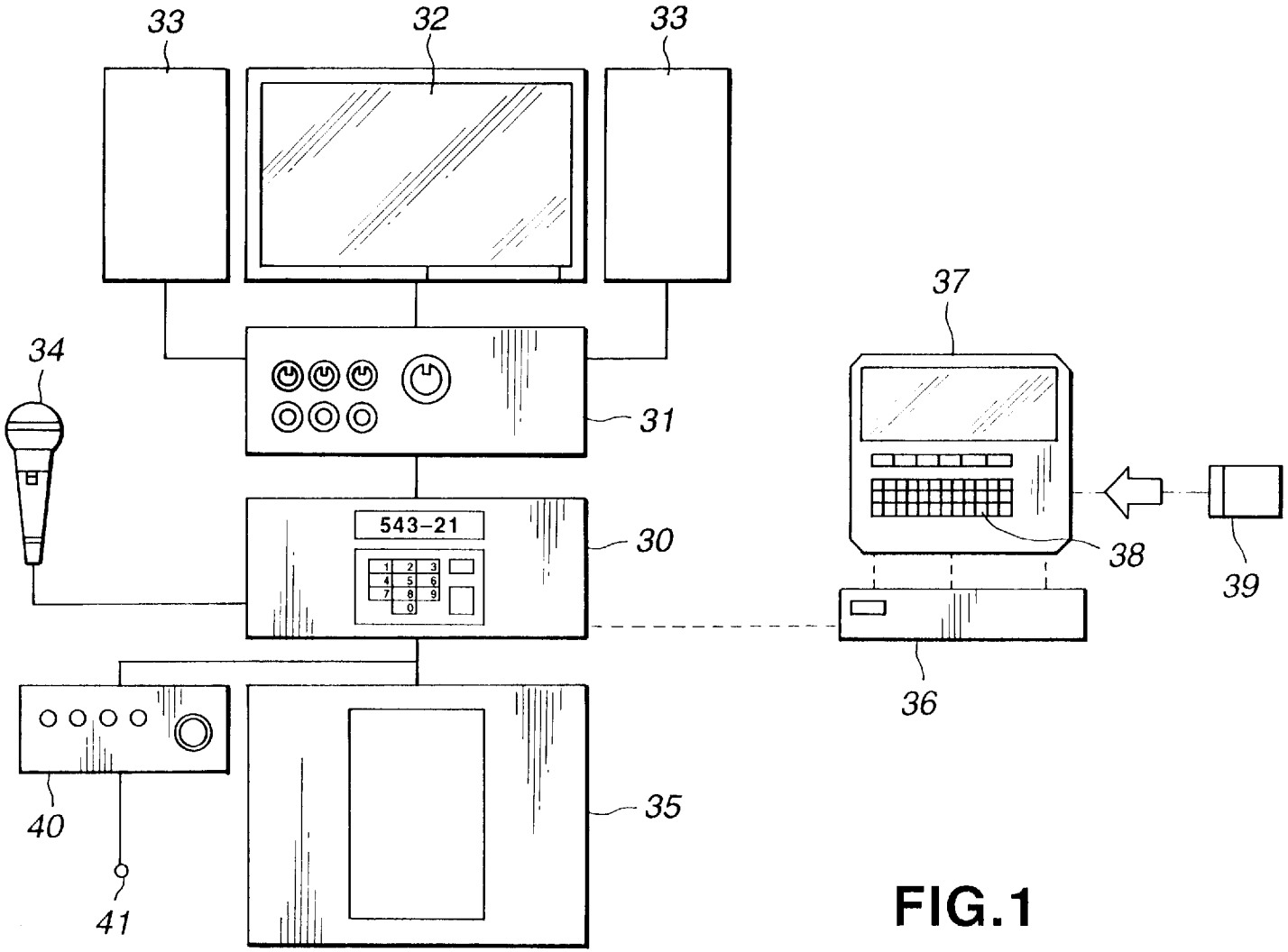
FIG. 1 is a block diagram of showing a configuration of a sound reproducing apparatus in accordance with the present invention.
Figure 2:
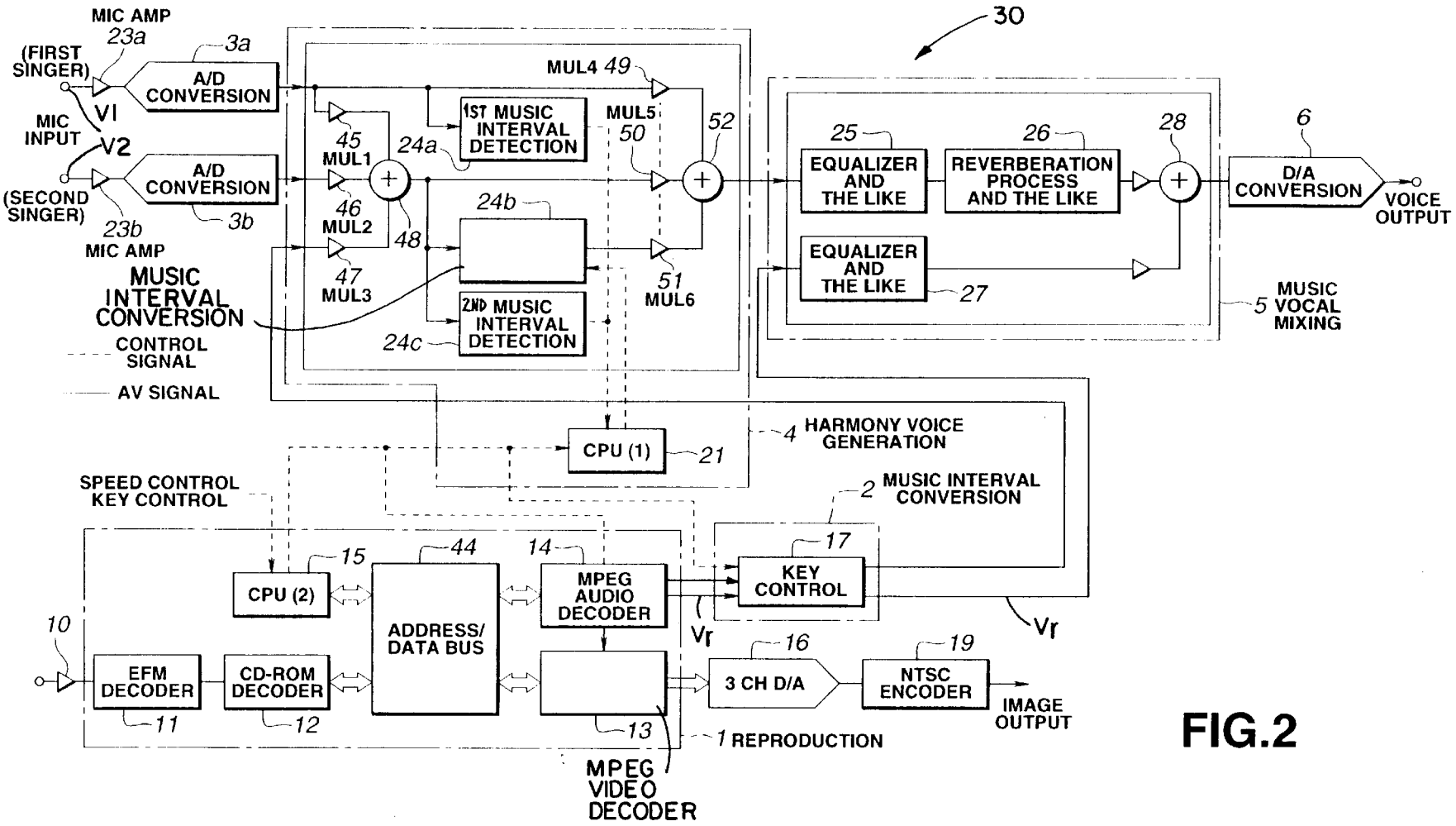
FIG. 2 is a block diagram of showing a configuration of a controller of the sound reproducing apparatus, FIGS. 3(*a*) to 3(*c*) are block diagrams of showing signal record formats of disks used in the sound reproducing apparatus.

As shown in FIGS. 1 and 2, the sound reproducing apparatus in accordance with the present invention includes a controller 30 provided with a built-in reproducing section 1. A first signal processing unit (CPU (1)) 21 is also built in the controller 30.

A disk changer 35 or a receiving device 40 is connected to the controller 30.

The disk changer 35 accommodates a disk as an information signal record medium, such as a plurality of optical disks, and includes a spindle motor and an optical head to reproduce these disks. This disk changer 35 selectively reproduces a plurality of disks to thereby output music information to the controller 30.

A receiving device 40 receives, through an input terminal 40, music information (MIDI data) sent by a public telephone line, such as a telephone line, an ISDN line and the like, and outputs the music information to the controller 30.

The music information and image information of each musical piece are sent to the controller 30 through the disk changer 35 or the receiving device 40. A sound signal and an image signal relative to the music information and the image signal are sent to an amplifier 31.

At each of these music information sources, song standard information in a condition multiplexed for the music information is sent to the controller 30. This song standard information represents a standard song which is sung by a professional singer and corresponds to the music information, and indicates a tone quality, a music interval and a length of tones constituting the standard song.

The amplifier 31 amplifies the sent sound signal and reproduces it by means of speakers 33 and 33, and further displays an image on a TV (television) monitor 32, on the basis of the sent image signal.

A first microphone device 34 is connected to the controller 30. A first voice (a voice of a first singer) is sent through the first microphone device 34 to the controller 30. As shown in FIG. 2, a first voice signal V1 relative to the first voice is sent, through a first microphone amplifier 23*a* and a first A/D converter 3*a* within the controller 30, to a harmony voice generating section 4 within the controller 30. This harmony voice generating section 4 is provided with the first signal processing unit 21.

A second microphone device (not shown) is connected to the controller 30. Similarly to the first microphone device 34, a second voice (a voice of a second singer) is sent through the second microphone device to the controller 30. As shown in FIG. 2, a second voice signal V2 relative to the second voice is sent, through a second microphone amplifier 23*b* and a second A/D converter 3*b* within the controller 30, to the harmony voice generating section 4.

In the controller 30, the music information sent by the disk changer 35 is sent through an RF amplifier 10 to a reproducing section 1. In this reproducing section 1, the music information sent by the RF amplifier 10 is sent to an EFM decoder 11. An EFM demodulation, an error correction process and the like of the sent music information are carried out by the EFM decoder 11.

An output signal from the EFM decoder 11 is sent to a CD-ROM decoder 12. Then, a decoding process in conformity to what is called a CD-ROM format is carried out for the output signal. Sound data including the music information and the song standard information among signals that are decoding-processed by the CD-ROM decoder 12 is sent through an address data bus 44 to an MPEG (Motion Picture Experts Group) sound decoder 14.

Video data, among the signals that are decoding-processed by the CD-ROM decoder 12, is sent through the address data bus 44 to the MPEG video (VIDEO) decoder 13.

Reproduction time information (SUB-CODE) read out from the music information is outputted by the EFM decoder 11 through the CD-ROM decoder 12 and sent through the address data bus 44 to a second signal processing unit (CPU (2)) 15, which controls respective decoders 12, 13 and 14 within the reproducing section 1.

In the MPEG video decoder 13, the decoding (extending) process is carried out for the video data compressed in what is called an MPEG manner. Then, a signal of each of the primary colors of R (red), G (green) and B (blue) is obtained. The signal of each of the primary colors is sent to a three-channel D/A converter (3 CHD/A) 16, and converted into an analog signal to be sent to an NTSC encoder 19. In the NTSC encoder 19, the signal of each of the primary colors is sent, as an image signal which is what is called a NTSC-type of a composite video signal, through an image output terminal to the TV monitor 32.

In the MPEG sound decoder 14, the decoding (extending) process is carried out for the sound data compressed in what is called an MPEG manner. Then, a music signal that is a digital sound signal, and a song standard signal Vr are obtained. This music signal is a signal corresponding to the music information. The song song standard signal Vr is a signal corresponding to the standard song information. The music signal and the standard signal Vr are sent to a key control circuit 17 constituting a music interval converting section 2.

The key control circuit 17 carries out a key converting process and a speed converting process, based on a key control signal and a speed control signal which are inputted from the second signal processing unit 15, and further sends the music signal to a music vocal mixing section 5 and also sends the standard song signal Vr to the harmony voice generating section 4.

The key control signal and the speed control signal are inputted to the second signal processing unit 15, based on a manual operation at a front surface of the controller 30 or an operation section (not shown) mounted on the microphone device 34.

In the music vocal mixing section 5, the music signal outputted by the harmony voice generating section 4 is frequency-characteristics-processed by an equalizer 27 to be sent through an amplifier to a mixer circuit 28.

In the case that the music information is sent to the controller 30 from the receiving device 40, the reproducing section 1 can be provided with a MIDI interface, a MIDI tone source unit and an image signal process circuit, instead of the respective decoders 11 to 14. That is, in this case, as the music information received by the receiving device 40 is sent through the MIDI interface to the MIDI tone source unit, this MIDI tone source unit outputs the music signal and the standard signal Vr. The music information received by the receiving device 40 is converted into the image signal by the image signal process circuit, and outputted to the controller 30.

On the other hand, the first voice signal V1 and the second voice signal V2 are amplified by the microphone amplifiers 23*a*, 23*b*, respectively, and converted into the first and second voice signals V1, V2, which are the digital signals, by the A/D converters 3*a*, 3*b* respectively, and sent to the harmony voice generating section 4.

In the harmony voice generating section 4, the first voice signal V1 is sent to a first selector (MUL1) 45, a first music interval detection circuit 24*a* and a fourth selector (MUL4) 49. Passing amounts of the first voice signal V1 in the first and fourth selectors 45, 49 are controlled by the first signal processing unit 21. An output of the first selector 45 is sent to a first mixer circuit 48. An output of the fourth selector 49 is sent to a second mixer circuit 52. The first music interval detection circuit 24*a* detects, on the basis of the first voice signal V1, a music interval of the first voice corresponding to this first voice signal V1. A result detected by the first music interval detection circuit 24*a* is sent to the first signal processing unit 21, as first song music interval information fV1.

In the harmony voice generating section 4, the second voice signal V2 is sent to a second selector (MUL2) 46. A passing amount of the second voice signal V2 in the second selector 46 is controlled by the first signal processing unit 21. An output of the second selector 46 is sent to the first mixer circuit 48. In the harmony voice generating section 4, the song standard signal Vr is sent to a third selector (MUL3) 47. A passing amount of the song standard signal Vr in the third selector 47 is controlled by the first signal processing unit 21. An output of the third selector 47 is sent to the first mixer circuit 48.

An output of the first mixer circuit 48 is sent to a second music interval detection circuit 24*c*, a music interval conversion circuit 24*b* and a fifth selector (MUL5) 50. A passing amount of the signal in the fifth selector 50 is controlled by the first signal processing unit 21. An output of the fifth selector 50 is sent to the second mixer circuit 52.

The second music interval detection circuit 24*c* detects, on the basis of any one of the respective voice signals V1, V2 and the song standard signal Vr, a music interval of a voice corresponding to the signal. A result detected by the second music interval detection circuit 24*c* is sent to the first signal processing unit 21, as the first song music interval information fV1 indicating the music interval detected for the first voice signal V1, a second song music interval information fV2 indicating a music interval detested for the second voice signal V2 or a standard music interval information fVr indicating a music interval detected for the song standard signal Vr.

The music interval conversion circuit 24*b* generates and outputs a harmony signal indicating, on the basis of any one of the respective sent voice signals V1, V2 an the song standard signal Vr, a voice in which the music interval of the voice corresponding to this signal is changed by a predetermined amount as described later. A harmony signal generated on the basis of the first voice signal V1 becomes a first harmony signal Vh1. A harmony signal generated on the basis of the second voice signal V2 becomes a second harmony signal Vh2. A harmony signal generated on the basis of the song standard signal Vr becomes a third harmony signal Vhr.

An output of the music interval conversion circuit 24*b* is sent to a sixth selector (MUL6) 51. Passing amounts of the respective harmony signals Vh1, Vh2 and Vhr in this sixth selector 51 are controlled by the first signal processing unit 21. An output of the sixth selector 51 is sent to the second mixer circuit 52.

The second mixer circuit 52 mixes any one of the respective voice signals V1, V2 and the standard song signal Vr with any one of the respective harmony signals Vh1, Vh2 and Vhr to thereby output as a harmony mixture signal to the mixing section 5.

In the mixing section 5, the harmony mixture voice signal is frequency-characteristics-processed by the equalizer 25, and is further reverberation-tone-processed by a reverberation process circuit 26, and sent through an amplifier to the mixer circuit 28.

In the mixer circuit 28, the harmony mixture voice signal and the music signal are mixed with each other, and sent to the D/A converter 6. This D/A converter 6 converts the sent digital signal into a sound signal, which is an analog signal, to thereby output through a sound output terminal to the amplifier 31.

In the disk reproduced by the disk changer 35, for example, in a disk called a video CD, a read-in area 101 is disposed on the innermost circumference of the disk, as shown in FIG. 3 A. TOC (Table of Contents) data is recorded on the read-in area 101. A start position of each of tracks in the disk, a track number, a play time and the like are recorded on this TOC data.

In the disk, track data is recorded on an inner circumference of the read-in area 101, from a first track (track #1) 102, a second track (track #2) 103, and a third track (track #3) 104 to a n-th track (track #n) 105.

In this disk, a read-out area 106 is disposed on an outer circumference of each of the tracks.

Figures 3A, 3B, 3C:
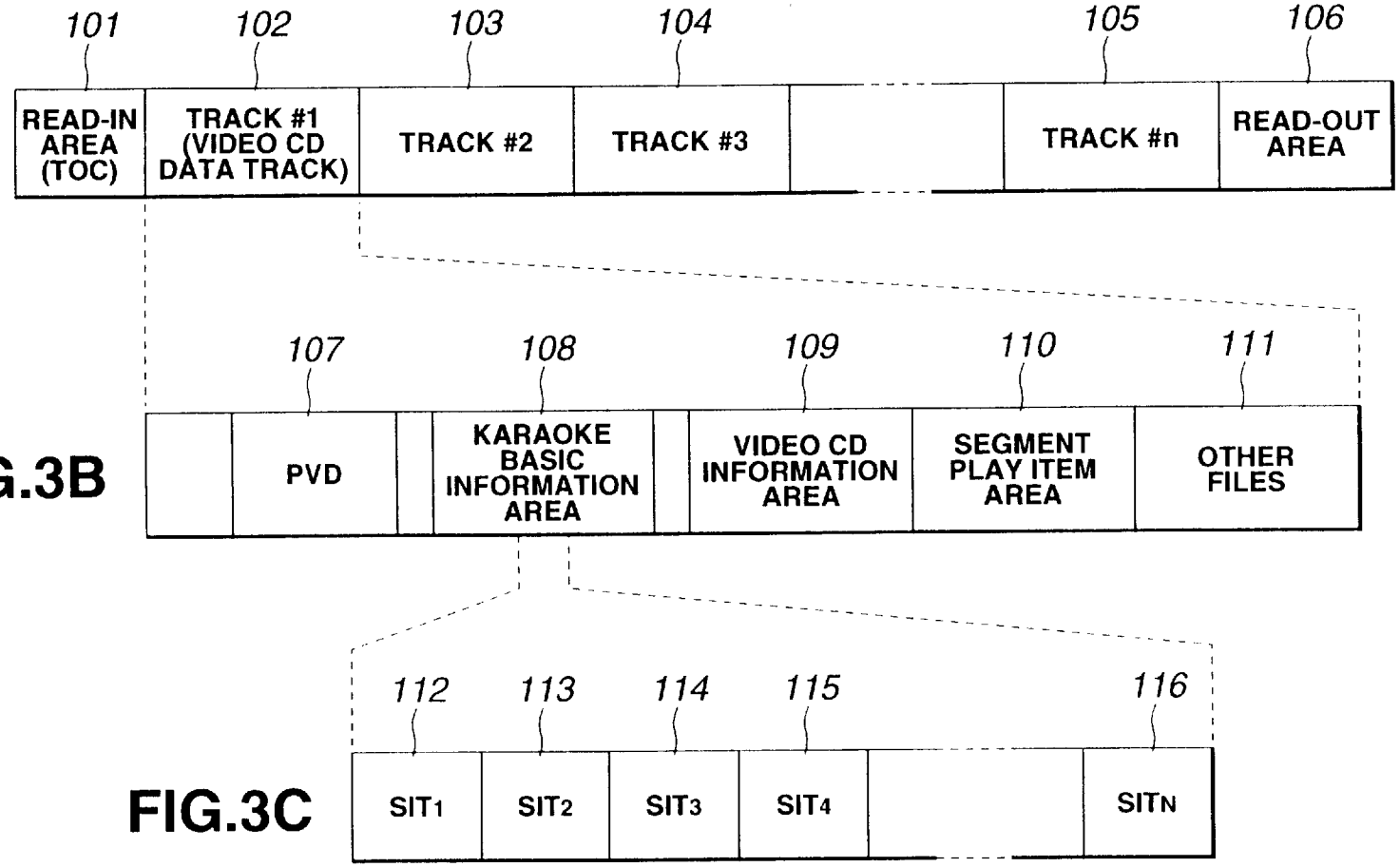

In this disk, as shown in FIG. 3B, the first track 101 is used as a data track, and not used to record the music information and the image information. The data track is composed of a PVD (primary volume descriptor) 107, a Karaoke basic information area 108, a video CD information area 109, a segment play item area 110 and other files (for example, for recording a CD-I application program and the like).

In this disk, data (KARINFO.CC) in relation to respective music pieces relative to the respective music pieces stored in the second track 103 to the n-th track 105 (for example, a name of a player, a name of a composer and a name of an arranger, a released date, a tone area of a song part, a melody, a tempo, a genre of a music piece and the like) are recorded on the Karaoke basic information area 108.

As shown in FIG. 3C, the data in relation to the respective music pieces is recorded as first to n-th sequence item tables SIT1 to SITn (SITi). In each of the sequence item tables SITi, one sequence item table SITi corresponds to one song of the music pieces.

Four item columns from item numbers 0 to 64 are provided on these sequence item tables SITi. Information of each of items shown in the following Table 1 is recorded thereon, respectively.

TABLE 1

| | Item Number | Content |
|---|---|---|
| — | 0–7 | (Disk Item) |
| Essential | 8 | Song ISRC Cord |
| Essential | 9 | Song Name |
| Option | 10 | Song Name (For Order Change) |
| Essential | 11 | Name of Player |
| Option | 12 | Name of Player (For Order Change) |
| Essential | 13 | Name of Song Writer |
| Essential | 14 | Name of Composer |
| Option | 15 | Name of Arranger |
| Option | 16 | Name of Original Player |

TABLE 1-continued

| | Item Number | Content |
|---|---|---|
| Option | 17 | Header for Song Word |
| Option | 18 | Song Word |
| Option | 19 | Scale of Karaoke (Music Interval) |
| Option | 20 | Scale of Raw Song |
| Option | 21 | Detailed Content of Song |
| Option | 22–31 | Maker Defination Item |
| Option | 32–64 | Reserve Area |

SITi Sequence Item Table

The scale (music interval) information recorded in the item number 19 indicates an inherent music interval of a song melody in each of the music pieces. This scale (music interval) information is composed of, for example, a music interval data block which is formed by 12 bytes and represents one tone.

Figure 4:
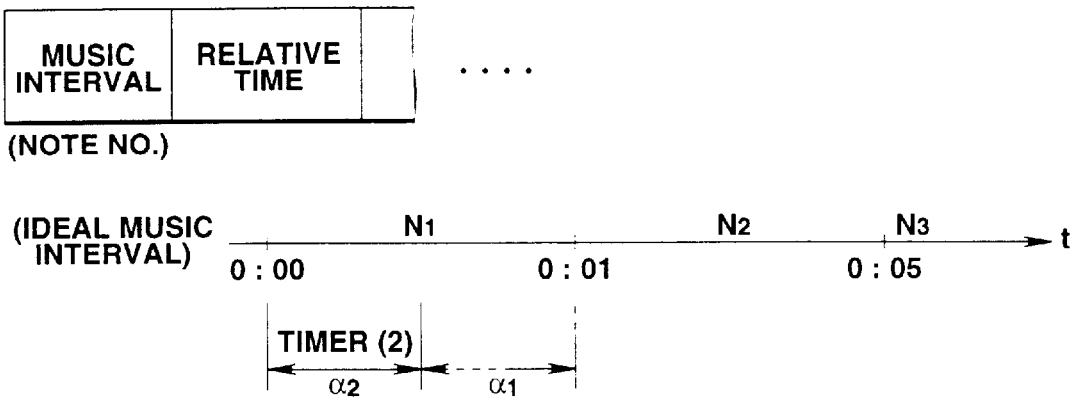
FIG. 4 is a time chart of showing a configuration of a music interval data block including ideal music interval information.

In the scale (music interval) information, at first, the music interval (note number) is represented with two bytes, as shown in FIG. 4. This music interval is represented as, for example, a value corresponding to each of the music intervals, such as C0 to G#7 (C0, C#0, D0, D#0, E0, F0, F#0, G0 . . . G7 and G#7). And, in this scale (music interval) information, a relative time (t) for which tones (N1, N2, N3 . . . ) of the music interval continue is represented by a byte following the byte indicative of the music information.

Figure 7:
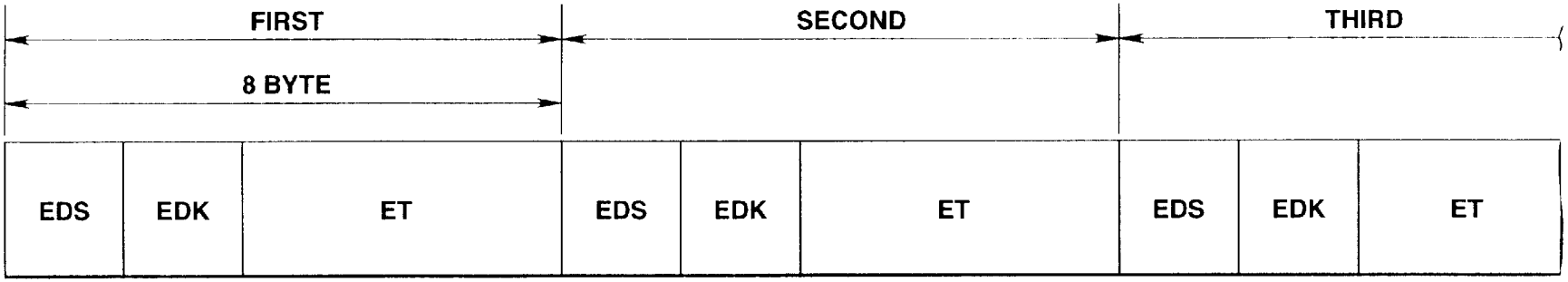
FIG. 7 is a block diagram of showing a structure of a data block indicating modulation information.

Modulation information indicative of a time position of the modulation in each of the music pieces and a key after the modulation is recorded in any one of the item numbers 22 to 31. In this modulation information, an area with 8 bytes per modulation is allocated, as shown in FIG. 7. A first byte among the eight bytes allocated for each modulation is EDS data indicative of a music step (scale) name, as shown in the following Table 2. A second byte among the eight bytes is EDK data indicative of a tonic, as shown in the following Table 3.

TABLE 2

| EDS | Music Interval (Tune) |
|---|---|
| 20H | Major Scale |
| 21H | Minor Scale |
| 22H | Dorian Scale |
| 23H | Lydian Scale |
| 24H | Mix-Lydian Scale |
| 25H | Phrygian Scale |
| 26H | Locrian Scale |

TABLE 3

| EDK | Music Interval |
|---|---|
| 30H | C |
| 31H | D♭ |
| 32H | D |
| 33H | E♭ |
| 34H | E |
| 35H | F |
| 36H | G♭ |
| 37H | G |
| 38H | A♭ |
| 39H | A |
| 3AH | B♭ |
| 3BH | B |

The key after the modulation is indicated by the EDS data and the EDK data. That is, for example, if the EDS data is 22H (H represents a hexadecimal number) and the EDK data is 34H, it is indicated that the key after the modulation is E Dorian Scale. Similarly, if the EDS data is 23H and the EDK data is 35H, it is indicated that the key after the modulation is F Lydian Scale.

The third to eighth bytes among the eight bytes allocated after each modulation is ET data indicative of a minute and a second of the time position to be modulated and a frame. Based on the ET data, the modulation position is specified by an absolute address indicative of a reproduction position in the disk, namely, data of a through time written on a top header of each of sectors on the disk.

In the second to n-th tracks 103, 104 and 105 of the disk, the recording of the music information on a sound sector and the recording of the image information on the video sector are carried out in a time sharing manner. The video sectors and the sound sectors are placed at an approximate ratio of 6 to 1, on average.

Image information (video data), which is referred to as an I picture, a P picture and a B picture and is compression-encoded in the MPEG manner is recorded on the video sector. Music information (sound data) which is compression-encoded in the MPEG manner is recorded on the sound sector.

In Video CD, the number of the tracks is 99 at its maximum. Thus, in this Video CD, it is possible to record a maximum of 94 sequences. The sequence means one block in which a dynamic picture is continuing, and one sequence refers to one song (one track) in the Karaoke disk.

In the sound reproducing apparatus having the above mentioned configuration in accordance with the present invention, since the first central processing unit 21 carries out a predetermined control for the harmony voice generating section 4, the music signal and the harmony mixture signal are mixed with each other and reproduced. This harmony mixture signal is a signal in which the first voice signal V1 is mixed with any one of the harmony signals Vh1, Vh2 and Vhr.

The respective harmony signals Vh1, Vh2 and Vhr are the signals generated by converting the respective voice signals V1, V2 and the song standard signal Vr into the signals indicative of the music interval corresponding to the first voice signal V1, that is, a music interval having a relation of a harmony to a music interval of the first voice.

The music interval having the relation of the harmony to the music interval of the first voice is, for example, the music interval lower than that of the first voice by three degrees.

A music interval higher than that of the first voice by three or five degrees is also the music interval having the relation of the harmony to the music harmony of the first voice. However, the addition of the voice of the music interval higher than the first voice to the first voice causes the emphasis on the first voice to be difficult. A music interval lower than that of the first voice by five degrees is also the music interval having the relation of the harmony to the music interval of the first voice. However, in this case, there is the case that the added voice may be an extremely lower tone. In many cases, it may be difficult to represent a proper harmony.

The music interval having the relation of the harmony to the music interval of the first voice is determined by the first central processing unit 21.

Figure 5:
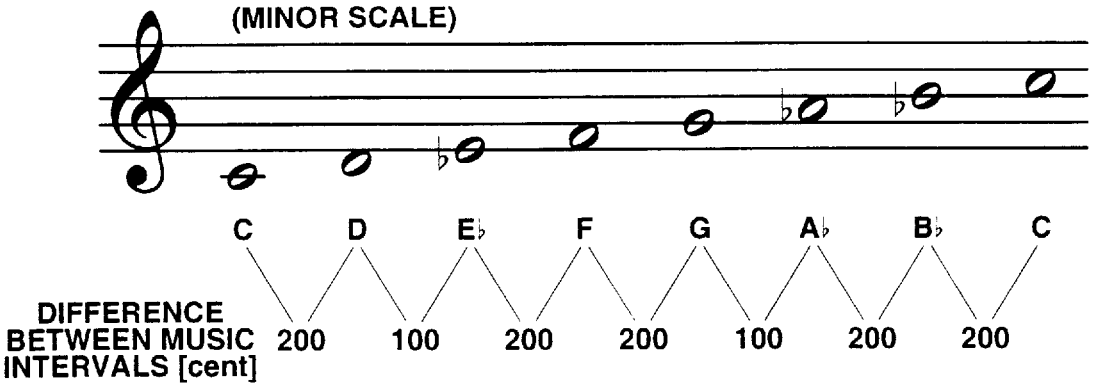
FIG. 5 is a score of showing a scale of a minor scale.

A difference (frequency ratio) between the music interval of the first voice and the music interval having the relation of the harmony thereto that are different from each other, is based on the key at a time of generating the respective harmony signals Vh1, Vh2 and Vhr in the respective music pieces. For example, as shown in FIG. 5, on the C Minor Scale, a tone lower than a music interval of [A♭] by three degrees is that of [F]. A difference between these music intervals is 300 cent (incidentally, a half tone is relative to 100 cent, and a whole tone is relative to 200 cent).

Figure 6:
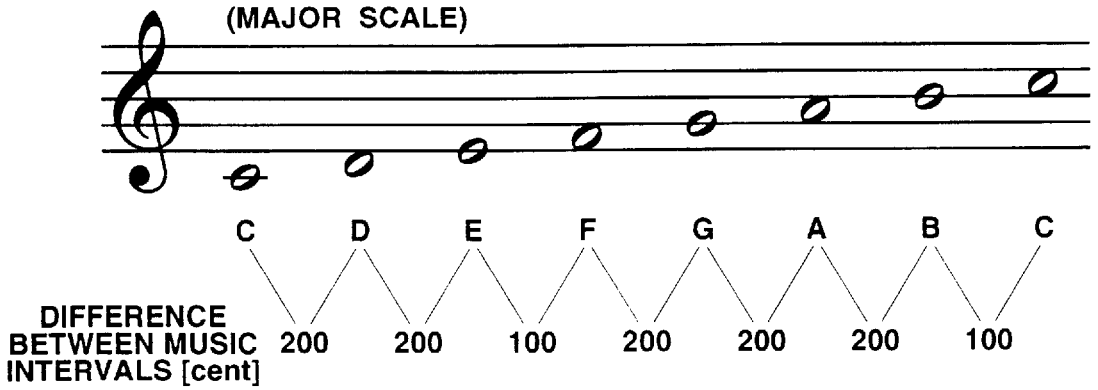
FIG. 6 is a score of showing a scale of a major scale.

However, on this [C Minor Scale], a tone lower than a music interval of [G] by three degrees is that of [E♭]. A difference between these music intervals is 400 cent. As shown in FIG. 6, on [C Major Scale], a tone lower than a music interval of [A] by three degrees is that of [F], and a difference between these music intervals is 400 cent.

For this reason, the first signal processing unit 21 determines the music intervals indicated by the respective harmony signals Vh1, Vh2 and Vhr, on the basis of the first song music interval information fV1, and the EDS data and the EDK data recorded on the sequence item table SITi.

The following are exemplary values for the determination of the music intervals indicated by the respective harmony signals Vh1, Vh2 and Vh3 by the first central processing unit 21.

Let the first song music interval information fV1, the second song music interval information fV2 and the standard music interval information fVr have the values described below:

$$fV1=[A\flat 4]+\Delta 1+\Delta k \quad \text{(Equation 1)}$$

$$fV2=[A\flat 4]+\Delta 2+\Delta k \quad \text{(Equation 2)}$$

$$fVr=[A\flat 4]+\Delta k \quad \text{(Equation 3)}$$

The Δk is a difference of music intervals generated under a key control by a key control circuit 17, and uniformly changes all the respective music interval information fV1, fV2 and fVr. This difference of the music intervals is adjusted by a singer, for the singer to match a tone area of the music piece to a tone area that can be sung by the singer. In this actual example, the Δk is assumed to be +50 cent (+2.9% in frequency).

The Δ1 and the Δ2 are respective differences of music intervals relative to amounts departed from melodies of inherent songs, in the songs of first and second singers. In the above mentioned example, the Δ1 is assumed to be 40 cent, and the Δ2 is assumed to be 30 cent. In the above mentioned example, the inherent music interval is [A♭]. Substituting the values to the equations (1) to (3) as shown below, then:

$$fV1=[A\flat 4]+40\text{ cent}+50\text{ cent}=[A\flat 4]+90\text{ cent} \quad \text{(Equation 4)}$$

$$fV2=[A\flat 4]+30\text{ cent}+50\text{ cent}=[A\flat 4]+80\text{ cent} \quad \text{(Equation 5)}$$

$$fVr=[A\flat 4]+50\text{ cent} \quad \text{(Equation 6)}$$

Assuming that the key of the music piece is [C minor Scale], the music interval lower than that of [A♭] by three degrees is that of [F]. The music interval difference of the music interval of [F] with respect to that of [A♭] is −300 cent, as shown in FIG. 5. Thus, the harmony music interval fVh indicated by each of the harmony signals Vh1, Vh2 and Vh3 is a music interval lower, by 300 cent, than that indicated by the fist song music interval information fV1.

$$\begin{aligned} fVh &= [A\flat 4]+90\text{ cent}-300\text{ cent}=[F4]+90\text{ cent} \quad \text{(Equation 7)} \\ &= [A\flat 4]-210\text{ cent} \end{aligned}$$

Thus, in a case of generating the first harmony signal Vh1, the music interval indicated by the first voice signal V1 is lowered by a difference P1 between the first song music interval information fV1 and the harmony music interval fVh.

$$\begin{aligned} P1 &= ([A\flat 4]+90\text{ cent})-([A\flat 4]-210\text{ cent}) \quad \text{(Equation 8)} \\ &= 300\text{ cent} \end{aligned}$$

In a case of generating the second harmony signal Vh2, the music interval indicated by the second voice signal V2 is lowered by a difference P2 between the second song music interval information fV2 and the harmony music interval fVh.

$$\begin{aligned} P2 &= ([A\flat 4]+80\text{ cent})-([A\flat 4]-210\text{ cent}) \quad \text{(Equation 9)} \\ &= 290\text{ cent} \end{aligned}$$

In a case of generating the third harmony signal Vhr, the music interval indicated by the song standard signal Vr is lowered by a difference P3 between the standard music interval information fVr and the harmony music interval fVh.

$$\begin{aligned} P3 &= ([A\flat 4]+50\text{ cent})-([A\flat 4]-210\text{ cent}) \quad \text{(Equation 10)} \\ &= 260\text{ cent} \end{aligned}$$

In the sound reproducing apparatus, the first central processing unit 21 selectively switches between the respective selectors 45, 46, 47, 49, 50 and 51 in the harmony voice generating section 4.

When the first selector 45 is in a passing state, the second selector 46 is in a breaking state, the third selector 47 is in the breaking state, the fourth selector 49 is in the passing state, the fifth selector 50 is in the breaking state and the sixth selector 51 is in the passing state, the harmony voice generating section 4 determines a music interval of a harmony tone having a relation of a harmony to the first voice, while the reproducing section 1 is outputting the music signal. Then, it generates a first harmony signal Vh1 indicative of a voice in which the music interval of the first voice is converted into that of the harmony tone based on the first voice signal V1.

When the first selector 45 is in the breaking state, the second selector 46 is in the breaking state, the third selector 47 is in the passing state, the fourth selector 49 is in the passing state, the fifth selector 50 is in the breaking state and the sixth selector 51 is in the passing state, the harmony voice generating section 4 determines a music interval of a harmony tone having a relation of a harmony to the first voice, while the reproducing section 1 is outputting the music signal. Then, it generates a third harmony signal Vhr indicative of a voice in which the music interval of the standard song is converted into that of the harmony tone based on the standard song information.

That is, the harmony voice generating section 4 can switch between a state of generating the fist harmony signal Vhr and a state of generating the first harmony signal Vh1 indicative of the voice in which the music interval of the first voice is converted into that of the harmony tone based on the first voice signal V1.

When the first selector 45 is in the breaking state, the second selector 46 is in the passing state, the third selector 47 is in the breaking state, the fourth selector 49 is in the passing state, the fifth selector 50 is in the breaking state and the sixth selector 51 is in the passing state, the harmony voice generating section 4 determines the music interval of the harmony voice, while the reproducing section 1 is outputting the music signal. Then, it generates a second harmony signal Vh2 indicative of a voice in which the music interval of the second voice is converted into that of the harmony tone based on the second voice signal V2.

The harmony voice generating section 4 can be switched in a state of generating the first harmony signal Vh1, a state of generating the second harmony signal Vh2 or a state of generating the third harmony signal Vhr.

Incidentally, in the harmony voice generating section 4 of this sound reproducing apparatus, the music interval as a standard of determining the harmony music interval fVh may be the second song music interval information fV2 (the music interval indicated by the second voice signal V2) or the standard music interval information fVr (the music interval indicated by the song standard signal Vr).

An explanation with reference to the equations (1) to (10) will be given. As shown in the equations (4) to (6), fV1=[A♭4]+90 cent, fV2=[A♭4]+80 cent, and fVr=[A♭4]+50 cent. The key of the song piece is [C Minor Scale]. The music interval lower than that of [A♭] by three degrees is that of [F]. The music interval difference of [F] with respect to that of [A♭] is −300 cent as shown in FIG. 5.

Assuming that the music interval as the standard to determine the harmony music interval fVh is that indicated by the second song music interval information fV2, the harmony music interval fVh becomes lower by 300 cent than that indicated by the second song music interval information fV2.

$$fVh = [A\flat 4] + 80\text{ cent} - 300\text{ cent} = [A\flat 4] - 220\text{ cent} \quad \text{(Equation 11)}$$

Here, in a case of generating the first harmony signal Vh1, the music interval indicated by the first voice signal V1 is lowered by the difference P1 between the first song music interval information fV1 and the harmony music interval fVh.

$$P1 = ([A\flat 4] + 90\text{ cent}) - ([A\flat 4] - 220\text{ cent}) = 310\text{ cent} \quad \text{(Equation 12)}$$

In a case of generating the second harmony signal Vh2, the music interval indicated by the second voice signal V2 is lowered by the difference P2 between the second song music interval information fV2 and the harmony music interval fVh.

$$P2 = ([A\flat 4] + 80\text{ cent}) - ([A\flat 4] - 220\text{ cent}) = 300\text{ cent} \quad \text{(Equation 13)}$$

Further, in a case of generating the third harmony signal Vhr, the music interval indicated by the song standard signal Vr is lowered by the difference P3 between the standard music interval information fVr and the harmony music interval fVh.

$$P3 = ([A\flat 4] + 50\text{ cent}) - ([A\flat 4] - 220\text{ cent}) = 270\text{ cent} \quad \text{(Equation 14)}$$

Assuming that the music interval as the standard to determine the harmony music interval fVh is that indicated by the standard music interval information fVr, the harmony music interval fVh becomes lower by 300 cent than that indicated by the standard music interval information fVr.

$$fVh = [A\flat 4] + 50\text{ cent} - 300\text{ cent} = [A\flat 4] - 250\text{ cent} \quad \text{(Equation 15)}$$

Here, in a case of generating the first harmony signal Vh1, the music interval indicated by the first voice signal V1 is lowered by the difference P1 between the first song music interval information fV1 and the harmony music interval fVh.

$$P1 = ([A\flat 4] + 90\text{ cent}) - ([A\flat 4] - 250\text{ cent}) = 340\text{ cent} \quad \text{(Equation 16)}$$

In a case of generating the second harmony signal Vh2, the music interval indicated by the second voice signal V2 is lowered by the difference P2 between the second song music interval information fV2 and the harmony music interval fVh.

$$P2 = ([A\flat 4] + 80\text{ cent}) - ([A\flat 4] - 250\text{ cent}) = 330\text{ cent} \quad \text{(Equation 17)}$$

Further, in a case of generating the third harmony signal Vhr, the music interval indicated by the song standard signal Vr is lowered by the difference P3 between the standard music interval information fVr and the harmony music interval fVh.

$$P3 = ([A\flat 4] + 50\text{ cent}) - ([A\flat 4] - 250\text{ cent}) = 300\text{ cent} \quad \text{(Equation 18)}$$

When the first selector 45 is in the breaking state, the second selector 46 is in the breaking state, the third selector 47 is in the passing state, the fourth selector 49 is in the passing state, the fifth selector 50 is in the passing state and the sixth selector 51 is in the breaking state, the harmony voice generating section 4 defines the song standard signal Vr as a signal of assisting the song of the first singer to thereby mix it, in its state, with the first voice signal V1.

As mentioned above, in the sound reproducing apparatus in accordance with the present invention, the music signal and the harmony mixture signal are mixed with each other and reproduced. This harmony mixture signal is the signal mixed with any one of a harmony signal into which a voice signal based on a voice of a singer and a voice signal based on a voice of another singer are music-interval-converted and a harmony signal into which a standard song information sent from a standard song information source is music-interval-converted.

The harmony signal is a signal indicative of a music interval having a relation of a harmony to a music interval corresponding to the harmony signal.

That is, according to the present invention, it is possible to provide the sound reproducing apparatus, in which even if there is only one singer, based on a voice of the singer, it can have a tone quality different from that of the voice and also generate a harmony voice having a music interval with a relation of a harmony to the voice and then reproduce a voice having more than one music interval with different tone qualities to thereby constitute the harmony.

Many widely different embodiments of the present invention may be constructed without departing from the spirit and scope of the present invention. It should be understood that the present invention is not limited to the specific embodiment described in the specification, except as defined in the appended claims.

What is claimed is:

1. A sound reproducing apparatus that uses a microphone and a record medium on which an accompaniment sound signal, data indicative of a scale, and song standard information are recorded, said apparatus comprising:

a reproducing section for reproducing the accompaniment sound signal, the song standard information, and the data indicative of the scale from the record medium;

a signal generating section for generating a harmony signal relative to a sound signal from the microphone on the basis of the data indicative of the scale reproduced by said reproducing section and the song standard information; and an adding section for adding the sound signal from the microphone, the accompaniment sound signal reproduced by said reproducing section, and the harmony signal from said signal generating section to thereby produce an output signal.

2. The sound reproducing apparatus according to claim 1, wherein said apparatus further comprises a control section for controlling an addition ratio at which the harmony signal from said signal generating section is added in said adding section to the sound signal from said microphone.

3. The sound reproducing apparatus according to claim 2, wherein said signal generating section comprises a first music interval detecting section for detecting a music interval of the sound signal from the microphone and a second music interval detecting section for detecting a music interval of the song standard information reproduced from the record medium and wherein said control section controls the addition ratio of the harmony signal from said signal generating section and the sound signal from the microphone based on results detected by said first and second music interval detecting sections.

4. The sound reproducing apparatus according to claim 2, wherein said apparatus further comprises a voice input section connected to the microphone and wherein an output signal from said voice input section is sent to said signal generating section, converted into the harmony signal relative to the sound signal from the microphone, and sent to said adding section.

5. The sound reproducing apparatus according to claim 4, wherein said control section uses at least one of the data indicative of the scale reproduced by said reproducing section, the song standard information reproduced from the record medium, and the output signal from said voice input section to cause said signal generating section to generate the harmony signal relative to the sound signal from the microphone.

6. A sound reproducing apparatus that uses a record medium on which a digital accompaniment sound signal, data indicative of a scale, and song standard data are recorded, said apparatus comprising:

a reproducing section for reproducing the digital accompaniment sound signal, the song standard data, and the data indicative of the scale from the record medium;

a first converting section for converting a sound signal inputted from a microphone into a digital sound signal;

a signal generating section for generating a harmony signal relative to the digital sound signal from said first converting section on the basis of the data indicative of the scale reproduced by said reproducing section and the song standard data;

an adding section for adding the digital sound signal from said first converting section, the accompaniment sound signal reproduced by said reproducing section, and the harmony signal from said signal generating section to thereby produce a digital output signal; and a second converting section for converting the digital output signal from said adding section into an analog output signal.

7. The sound reproducing apparatus according to claim 6, wherein said apparatus further comprises a control section for controlling an addition ratio at which the harmony signal from said signal generating section is added in said adding section to the digital sound signal from said first converting section.

8. The sound reproducing apparatus according to claim 7, wherein said signal generating section comprises a first music interval detecting section for detecting a music interval of the sound signal from said microphone and a second music interval detecting section for detecting a music interval of the song standard information and wherein said control section controls the addition ratio of the harmony signal from said signal generating section and the sound signal from the microphone based on results detected by said first and second music interval detecting sections.

9. The sound reproducing apparatus according to claim 7, wherein said apparatus further comprises a voice input section connected to the microphone and wherein an output signal from said voice input section is sent to said signal generating section, converted into the harmony signal relative to the digital sound signal from said first converting section, and sent to said adding section.

10. The sound reproducing apparatus according to claim 9, wherein said control section uses at least one of the data indicative of the scale reproduced by said reproducing section, the song standard data, and the output signal from said voice input section to cause said signal generating section generated the harmony signal relative to the digital sound signal from said first converting section.

11. The sound reproducing section according to claim 9, wherein said voice input section is composed of an additional microphone and an additional converting section for converting an output signal from said additional microphone into an additional digital sound signal fed to said second converting section.

12. A sound reproducing apparatus including a microphone, comprising:

a receiving section for receiving a signal including an accompaniment sound signal, data indicative of a scale, and song standard data, said receiving section having a demodulating section for demodulating the received signal;

a signal generating section for generating a harmony signal relative to a sound signal from the microphone on the basis of the data indicative of the scale demodulated by said demodulating section and the song standard data; and an adding section for adding the sound signal from the microphone, the accompaniment sound signal from said receiving section and the harmony signal from said signal generating section to thereby produce an output signal.

13. The sound reproducing apparatus according to claim 12, wherein said apparatus further comprises a control section for controlling an addition ratio at which the harmony signal from said signal generating section is added in said adding section to the sound signal from said microphone.

14. The sound reproducing apparatus according to claim 13, wherein said signal generating section comprises a first music interval detecting section for detecting a music interval of the sound signal from the microphone and a second music interval detecting section for detecting a music interval of the song standard data from said receiving section and wherein said control section controls the addition ratio of the harmony signal from said signal generating section and the sound signal from the microphone based on results detected by said first and second music interval detecting sections.

15. The sound reproducing apparatus according to claim 13, wherein said apparatus further comprises a voice input section connected to the microphone and wherein an output signal from said voice input section is sent to said signal generating section, converted into the harmony signal relative to the sound signal from the microphone and sent to said adding section.

16. The sound reproducing apparatus according to claim 15, wherein said control section uses at least one of the data indicative of the scale reproduced by said reproducing section, the song standard data from said receiving section, and the output signal from said voice input section to cause said signal generating section generate the harmony signal relative to the sound signal from the microphone.

* * * * *